US007909041B2

(12) United States Patent
Yoneda et al.

(10) Patent No.: US 7,909,041 B2
(45) Date of Patent: Mar. 22, 2011

(54) DOUBLE-FACED ADHESIVE TAPE AND WING WITH THE SAME

(75) Inventors: Yoshihiro Yoneda, Tokyo (JP); Masahiro Makino, Tokyo (JP); Akemi Sato, Tokyo (JP); Mutsumi Kawasaki, Tokyo (JP); Kiwako Asakura, Tokyo (JP)

(73) Assignee: Unihair Co., Ltd., Tokyo (JP)

( * ) Notice: Subject to any disclaimer, the term of this patent is extended or adjusted under 35 U.S.C. 154(b) by 931 days.

(21) Appl. No.: 10/544,573

(22) PCT Filed: Jul. 15, 2004

(86) PCT No.: PCT/JP2004/010425

§ 371 (c)(1),
(2), (4) Date: Aug. 5, 2005

(87) PCT Pub. No.: WO2005/009157

PCT Pub. Date: Feb. 3, 2005

(65) Prior Publication Data

US 2006/0144413 A1 Jul. 6, 2006

(30) Foreign Application Priority Data

Jul. 28, 2003 (JP) ..... 2003-281367

(51) Int. Cl.
*A41G 3/00* (2006.01)
*B32B 7/12* (2006.01)

(52) U.S. Cl. ..... 132/53; 428/343

(58) Field of Classification Search ..... 132/201, 132/53–56; 428/343, 40.1, 40.2, 41.9, 141, 428/156, 195.1
See application file for complete search history.

(56) References Cited

U.S. PATENT DOCUMENTS 3,716,065 A 2/1973 Finamore
3,971,392 A 7/1976 Brehmer
(Continued)

FOREIGN PATENT DOCUMENTS

FR 371104 2/1907
(Continued)

OTHER PUBLICATIONS

Translation of the International Preliminary Report on Patentability of International Application No. PCT/JP 2004/101425, with Form PCT/IB/373 and Form PCT/ISA/237.

*Primary Examiner* — Cris L Rodriguez
*Assistant Examiner* — Rachel R Steitz
(74) *Attorney, Agent, or Firm* — Westerman, Hattori, Daniels & Adrian, LLP

(57) ABSTRACT

A double-stick adhesive tape (10) for fixing a wig (100) to a head, of which the surface of at least one side (12) of both sides of adhesive layers (12, 13) on a core material (11) is deglossed by forming minute concavity and convexity (12*a*), one side of adhesive layer (12) is formed to have a thickness to bury at least more than half of a wire diameter of the filament (103) used as a net member of a wig base (101), thereby one side of adhesive layer (12) is set inside of a network (104) of the net member, and bonded to the net member, a filament (103) is peripherally bonded with the adhesive layer (12) and the other adhesive layer (13) is bonded to the head.

4 Claims, 7 Drawing Sheets

U.S. PATENT DOCUMENTS

| | | | | |
|---|---|---|---|---|
| 4,456,019 | A | 6/1984 | Finamore | |
| 4,517,999 | A | 5/1985 | Finamore | |
| 4,825,886 | A | 5/1989 | Allen | |
| 5,368,052 | A | 11/1994 | Finamore | |
| 5,992,424 | A | 11/1999 | Repsha et al. | |
| 6,016,814 | A * | 1/2000 | Elliott | 132/201 |
| 6,170,491 | B1 * | 1/2001 | Maekawa | 132/201 |
| H002042 | H * | 8/2002 | Dobrin et al. | 428/152 |
| 2002/0056465 | A1 * | 5/2002 | Shin | 132/53 |
| 2004/0237987 | A1 * | 12/2004 | Gold | 132/201 |

FOREIGN PATENT DOCUMENTS

| | | |
|---|---|---|
| JP | 62-215002 | 9/1987 |
| JP | 02-216207 A | 8/1990 |
| JP | 7-305038 | 11/1995 |
| JP | 2001-329235 | 11/2001 |

* cited by examiner

DOUBLE-FACED ADHESIVE TAPE AND WING WITH THE SAME

TECHNICAL FIELD

The present invention relates to a wig suitable to hair fashion or hair enrichment as a typical purpose and in particular relates to double-stick adhesive tape used to fix a wig onto a head, and to a wig using said double-stick adhesive tape.

BACKGROUND ART

A wig is, in general, made up with a wig base mainly comprising artificial skin made of soft plastic material or net member and a number of hairs implanted to said wig base. If ventilation and lightness are aimed when a wig is worn, it has to be taken into consideration to make the weight of hair implanted to a wig base lighter, as well as how to make lighter the weight of a wig base. In order to make a lighter wig base, various technical developments have been tried, such as taking off a part of a wig base made of artificial skin, for example, a top part or both side parts, and connecting net member to said taken off part, thus making a wig base having partial net member, or making a whole wig base with net member, and reinforcing the rim by fringing with artificial skin made of synthetic plastics. Also, there are various wig bases such as that the hair line region of which is made of net member in order to attain the lightness and ventilation of a wig, and natural looking of hair line, as disclosed, for example, in Japanese Patent Preliminary Publication No. JP S62-215002A.

Meanwhile, in order to wear such a wig on a head, the backside of a wig base and the head must be firmly bonded with bonding means so that the wig does not scoot from the head or come off easily. As the conventional bonding means, commercially available liquid or viscous adhesive, commercial double-stick adhesive tape, or a clip specifically for binding a wig have been used, and a wig is fixed on to a head by either of these means. Put-on and take-off of a wig are made easier by using a clip specifically for binding a wig. A typical clip is such that fixes the inversion part provided with a plurality of comb-tooth like tips to the backside of a wig base, and binds to the wearer's own hair by inserting said tips to the hair, and utilizing the inversion action of the inversion part. Such a clip is not suitable to the case that the remaining hair is few at the fixing position of the head, since it is to utilize the wearer's own hair.

When liquid or viscous adhesive is used to bond a wig to the head, since it is applied between the head skin and the backside of a wig base and bond them, these for medical application which are inactive to skin and do not tend to cause such inflammation as rash are used. However, when a wig is taken off, since the adhesive stuck on the head skin has to be removed with peeling agent such as thinner, the skin tends to be damaged both physically and chemically, and taking-off itself is laborious.

In case of double-stick adhesive tape, peeling agent is almost not required, and put-on and take-off of a wig are easier than the case using liquid or viscous adhesives. As double-stick adhesive tape, a core material of polyethylene film of about 30 μm thickness is commercially available, of which both faces are coated with adhesive, and bonded with peeling paper, and which is rolled up. Said rolled up double-stick adhesive tape is cut to appropriate length, and the peeling paper is removed. Then one side of adhesive faces is bonded to the reinforcing material made of plastics attached to the backside of a wig base made of artificial skin or of net member, for example, at four places forth and back, left and right, and the other side of adhesive faces is bonded to the head skin or the hair so that the wig is fixed. As the layer thickness of the adhesive of double-stick adhesive tape, about 30 to 50 μm of low allergic acrylic medical adhesive is usually used, and is applied evenly to both sides of said core material.

In case that a whole or a part of a wig base is made of net member (This may be called hereinafter a net base.), the filament of nylon, polyester, or the like with diameter of about 100 to 150 μm as net base is used, and a sheet with network having rhomboidal or rectangular spaces is formed with said filament, a net base is formed with said sheet to a shape fit to the wearer's head shape, and a wig is made up with said net base with a number of hair implanted thereto. A wig wearer pulls outward the periphery of a net base so that it does not wrinkle or loosen, and fixes on to the head using a binder attached to the desired position of the backside of a net base, liquid or viscous adhesive applied to the head skin, or double-stick adhesive tape.

Since a wig is thus worn by pulling a net base in peripheral direction by applying external force, excess pulling tension is applied to the net base comprising thin filaments, thereby the net base may be distorted or broken. Therefore, it is required to fix the reinforcement member made of more or less hard plastics to the certain portion of a net base where load tends to be applied, particularly to its peripheral portion. Further in addition, in order to apply adhesive or attach a clip to the desired portion of the backside of a net base, it is necessary to make a bonding seat as the bonding means with another material such as soft plastics or cloths, and to fix said bonding seat to the predetermined portion of the backside of net base. Since said bonding seats are for attaching adhesive or a clip, they are generally made thick of another broad plastics or cloths, and are sewn firmly to several peripheral portions of the backside of a net base, thereby these parts can not help but become heavy and thick. Also, by setting the above-mentioned reinforcement members or bonding seats to a net base, the network of these parts are choked, thereby ventilation is interfered, and causes stuffiness, distortion, or deterioration.

Thus, it is preferred not to provide reinforcement members or bonding seats, in case lightness and ventilation of a net base are to be considered as important. If, for this reason, a bonding means is to be attached directly to a net base without reinforcement members or bonding seats, nothing but double-stick adhesive tape can be used as such bonding means instead of instant adhesive or a clip. Because, if a clip is directly set to the filaments of small diameter making up net base, said clip must be bound and sewn to a plurality of filaments, holding tight the clip to wearer's own hair while pulling a net base to peripheral direction causes excess tension to thin filaments, which results in dissociation of cross points of filaments, cutting off the filaments themselves, and ultimately the breach of the net base. In addition, said clip can be easily seen through hairs from the outside of a wig. On the other hand, if head skin or hair and a net base are tried to be directly adhered with liquid or viscous adhesive, the filaments of a net base and the wearer's head practically contact only linearly, and only such linear contact between filaments and a head causes easy scooting from the head, and therefore is not suitable to practical use.

Therefore, the inventors tried to bond directly, by using the commercially available medical double-stick adhesive tape, one side of adhesive surfaces to the desired position of the backside of a net base. In this case, one side of adhesive surfaces of double-stick adhesive tape was bonded directly to each filament making up a net base, and the other adhesive surface of double-stick adhesive tape was bonded to a wearer's head skin and hairs. If a wig is firmly fixed to a head when thus bonded, then the reinforcing material of plastics or cloth and a bonding seat are not required to be attached to the backside of a wig base, and hence sufficient ventilation and also reducing weight can be attained.

However, the various repeated experiments by the inventors made it clear that the attempt of direct bonding of one side of adhesive surfaces of double-stick adhesive tape to net base resulted in bonding only on linear contact as in the case of liquid or viscous adhesive, since the cross section of a filament making up a net was circular. This is because the thickness of one side of adhesive layers of commercially available medical double-stick adhesive tape is about 30 to 50 μm, whereas the filaments of 100 to 150 μm are usually used since the filament making up net base needs certain strength, so that pressing the adhesive layer of double-stick adhesive tape to net base causes only linear bonding along one side of the filament with a circular cross section.

Also in addition to it, it became clear that, since the network formed among crossing filaments, that is, net mesh was vacant space, most of adhesive surface was not utilized, and bonding was effected only in linear direction of a filament, so that adhesion was weak, and the worn wig easily came off a head. This was also a case when the adhesiveness of double-stick adhesive tape was enriched. Thus, it was confirmed that applying commercially available medical double-stick adhesive tape to a wig of net base proved to be impractical, as the bonding of adhesive to net base was too weak.

A wig was also test made with said commercially available medical double-stick adhesive tape applied to the backside of a net base, and its worn state was observed from outside, then head skin could be seen through hairs implanted to the net base from the network of each crossing filament, and said smooth side of adhesive surfaces of double-stick adhesive tape shone through network of each filament, which was recognized by an observer as unnatural reflection, and the part of adhesive surface was seen as floating up white due to this glossiness, resulting in easy recognition of the presence of double-stick adhesive tape.

Thus, wearing a wig comprising a net base on a head by using double-stick adhesive tape proved to have such problems as, sufficient bonding force could not be attained because only linear adhesion to net base was effected, and since adhesive surface of double-stick adhesive tape was smooth, the light which passed through a wig reflected on said smooth adhesive surface of double-stick adhesive tape bonded on the backside of net base, causing the presence of double-stick adhesive tape to be recognized through the hair of a wig.

The objective of the present invention is, referring to the problems mentioned above, to provide double-stick adhesive tape for wig bonding having sufficient adhesive force to a wig base comprising a net base, whereas not easily visible upon wearing, as well as a wig provided with said double-stick adhesive tape which has good appearance.

DISCLOSURE OF THE INVENTION

In order to achieve the object mentioned above, a double-stick adhesive tape used for fixing a wig to a head in accordance with one form of the embodiments of the present invention is characterized at least one surface of the both adhesive surface layers is deglossed.

Said adhesive layer is deglossed preferably by forming its surface with minute concavity and convexity.

Said minute concavity and convexity on the surface of adhesive layer can be provided either by pressing said adhesive layer with a press having minute saliences, or formed by spray-coating granular adhesive on the surface of core material. Or said minute concavity and convexity on the surface of adhesive layer may be formed by blast processing. In case of blast processing, if finely crushed dry ice or ice is used, then since the blast material melts after finishing the concavity and convex process on the adhesive layer, said blast material does not remain on the adhesive layer.

The surface roughness of said minute concavity and convexity is made preferably larger than light wavelength, thereby, when one side of the adhesive surface of double-stick adhesive tape for wig bonding is bonded to the backside of a wig, the light incoming from the outside of the wig on to the adhesive surface of the double-stick adhesive tape reflects diffusely, thereby unnatural light is not generated.

According to another embodiments, the present invention is characterized by a double-stick adhesive tape used for fixing a wig onto a head comprising net member at least as a portion of a wig base, and at least one side of its double-stick adhesive layers is formed to have a thickness to bury more than half of a wire diameter of said net member.

Further, the present invention is characterized by the double-stick adhesive tape used for fixing the wig onto a head comprising a net member at least as a portion of a wig base, and at least one side of its double-stick adhesive layers is formed to have a thickness to bury more than half of a wire diameter of said net member, and a surface of said one side of adhesive layers is deglossed.

In the constitution mentioned above, the one side of said adhesive layers is preferably formed to have a thickness equal to, or more than the wire diameter of said net member which constitutes at least a part of the wig base, and the surface of this side of adhesive layers is deglossed, and the other side of said adhesive layers is formed to have the thickness equal to, or more than a hair diameter. The one side, or both sides of said adhesive layers are preferably formed to have the thickness in the range between 50 and 200 μm, respectively.

Further, the wig of the present invention is characterized in that it is the wig comprising: a wig base having a net member at least as a portion; hairs implanted to said wig base, and the double-stick adhesive tapes having adhesive layers on both sides of core material respectively, with one side of the adhesive layers bonded to said wig base, and with the other side of the adhesive layers bonded to a wearer's head; and the surface of said one side of the adhesive layers of said double stick adhesive tape is deglossed, and said deglossed side of the adhesive layers is preferably set inside of the network of net member of a wig base, and bonded to said net member.

In the constitution mentioned above, the surface of one side of adhesive layers of double stick adhesive tape is deglossed preferably by forming minute concavity and convexity on it.

In accordance with the present invention, since the one side of adhesive layers of double-stick adhesive tape is deglossed by forming minute concavity and convexity, when the light comes in from outside of the wig to the adhesive layer with minute concavity and convexity located on filament network making up net member, it reflects diffusely on said minute concavity and convexity by bonding said deglossed surface of adhesive layer to said net member from its backside of a wig base. Consequently, an unnatural gloss disappears, and bonding of double-stick adhesive tape to the backside of the wig is not visible from outside, thereby fine looking can be attained.

Further, a wig of the present invention is characterized in that it is the wig comprising: a wig base having a net member at least as a portion; hairs implanted to said wig base, and double-stick adhesive tapes having adhesive layers on both sides of a core material respectively, with one side of the adhesive layers bonded to said wig base, and with the other side of the adhesive layers bonded to a wearer's head; and said one side of the adhesive layers of said double stick adhesive tape is formed to have a thickness to bury more than half of a wire diameter of said net member, and said one side of the adhesive layers is set inside of the network of net member, and bonded to said net member.

Said surface of one side of adhesive layers of said double-stick adhesive tape is deglossed preferably by forming minute concavity and convexity on it.

One side of adhesive layers of said double-stick adhesive tape is preferably formed to have the thickness equal to, or more than a wire diameter of the filament making up net member, and the surface of said one side of adhesive layers is deglossed. The other side of adhesive layers of double-stick adhesive tape is also preferably formed to have the thickness equal to, or more than the hair diameter. One side, or both sides of said adhesive layers are preferably formed to have the thickness in the range between 50 and 200 μm.

By making thick at least the side to be bonded to net member of the adhesive layers of double-stick adhesive tape, so thick as to bury more than half of the wire diameter of the net member, the high adhesivity can be attained, since the adhesive comes inside the network of filaments making up net member, and adheres peripherally by wrapping each filament when the double-stick adhesive tape is bonded to net member from the backside of the wig.

BEST MODES FOR CARRYING OUT THE INVENTION

Figure 1:
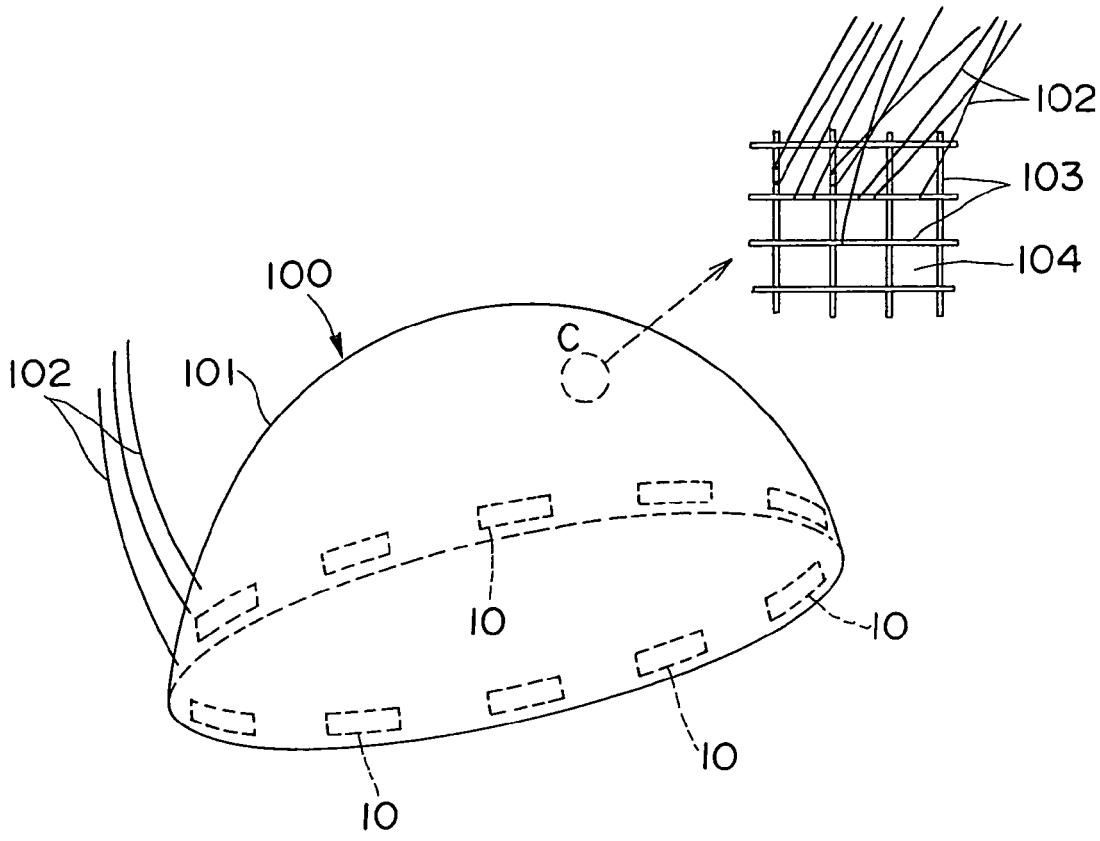
FIG. 1 is a perspective view illustrating a wig in accordance with an embodiment of the present invention.

The present invention will better be understood from the following detailed description and the drawings attached hereto showing certain illustrative forms of embodiment of the present invention. In this connection, it should be noted that such forms of embodiment illustrated in the accompanying drawings hereof are intended in no way to limit the present invention but to facilitate an explanation and an understanding thereof.

Hereinafter, a double-stick adhesive tape and a wig provided with the same in accordance with the present invention will be described with reference to certain suitable forms of implementation thereof illustrated in the drawing figures.

FIG. 1 illustrates an example of the structure of a wig 100 provided with double-stick adhesive tapes in accordance with the present invention. A double-stick adhesive tape 10 is used to fix a wig to a head, but in this embodiment it is used for a so-called partial wig or hairpiece 100 which has the shape the upper side of which more or less swells along the round shape of the wearer's head, for example, as illustrated in FIG. 1. In this illustration, the double-stick adhesive tape 10 is arranged at several positions discontinuously along the periphery of the inner side, that is, the backside of the partial wig 100, and one adhesive side of double-stick adhesive tape 10 is bonded to said wig 100 on the backside of a partial wig 100, while the other adhesive side is bonded to a wearer's head.

The partial wig 100 is made up by implanting hair 102 to a wig base 101 comprising a net member that makes up network as a whole. Although only a few attached hairs 102 are depicted in FIG. 1, many hairs are implanted in fact all over the surface of the wig base 101. Here, a wig base 101 may be not made up as a whole with net base as illustrated, but only the part corresponding, for example, to a comb out part or a hair whorl part is partially made up with artificial skin made of soft plastics, and the whole shape may be made up as cap-like by joining said artificial skin part and the residual net member, or only the parts to which the double-stick adhesive tape 10 is bonded may be made up with net member, and most other parts may be made up with artificial skin. The double-stick adhesive tape 10 of the present invention is preferably used especially when the wig base is made up with net member, but it is of course not limited to this case, but may also be applicable to the wig of such other materials as artificial skin. Also, a wig applicable to the present invention may be the partial wig 100 which partially covers the head as shown in FIG. 1, or a so-called whole wig of the type covering a wearer's whole head.

Here, the wig base 101 of the partial wig 100 illustrated in FIG. 1 is made up with net member, and a filament 103 made of either single filament or cord of nylon or polyester thread is used for said net base, and said filament 103 is woven, as shown in the enlarged figure C of FIG. 1, so as to form the gridiron network 104 consisting of rhomboid or rectangular spaces, thereby said wig base is made lightly into the shape to fit the bulge of a wearer's head. Although the material, denier, and count of filament 103 making up net member may be properly selected and used, in case that a net member is used as a wig base, the thinner the diameter of filament 103, the more advantageous it becomes to make a net base as light as possible, since its breathability and lightness are the most important factors. The thinner the diameter of filament, the more advantageous it also becomes since it becomes harder to be recognized. However, the thinner, the lower is breaking force, so that it is general custom to use the filament 103 of diameter about 100 to 150 μm of, for example, nylon, polyester, or the like for a wig net base. However, the filament 103 diameter smaller than that may be applicable enough to the present invention.

One method may be to use the flat sheet made of the filament 103 by plain weaving or tulle weaving to form the network 104 to form a bulge of cap shape along the desired head shape as the wig base 101, while another method may be to arrange filaments 103 as warp and weft, thermally fuse their cross points, and make it bulging in cap shape to form as a wig base 101.

The size of the network 104 made up by combination of warp and weft of the filament 103 may be arbitrarily selected depending upon the volume of implanted hair. Generally speaking, when the larger hair volume is desired, the smaller mesh may be adopted, and if the wearer's own hair is pulled out of mesh to be utilized by mixing up with the wig hair, then the mesh size may be made larger, for example, 1 $cm^2$ or more. The hair 102 to be implanted may be connected to warp and weft of the filament 103, respectively, by knotting, bonding, or the like, and the hair 102 may be knotted to cross points in some cases. In any case, since the hair 102 cannot be implanted in the formed meshes 104 as a matter of course, the wearer's head (head skin and hair) is likely to be seen in the attached hair 102 through network 104 when the user wears a wig. Consequently, since the double-stick adhesive tape 10 adhering to net member from the backside of the wig base 101 can also be seen through attached hair 102, the gloss of adhesive face located on the network 104 of the filament 103 is problematical, but according to the present invention as mentioned later, the surface of adhesive face of the double-stick adhesive tape 10 has diffuse reflection by deglossing treatment, thereby unnatural gloss is not generated. Therefore, the presence of the double-stick adhesive tape 10 is less likely to be seen through the attached hair from the outside of the wig.

Figure 2:
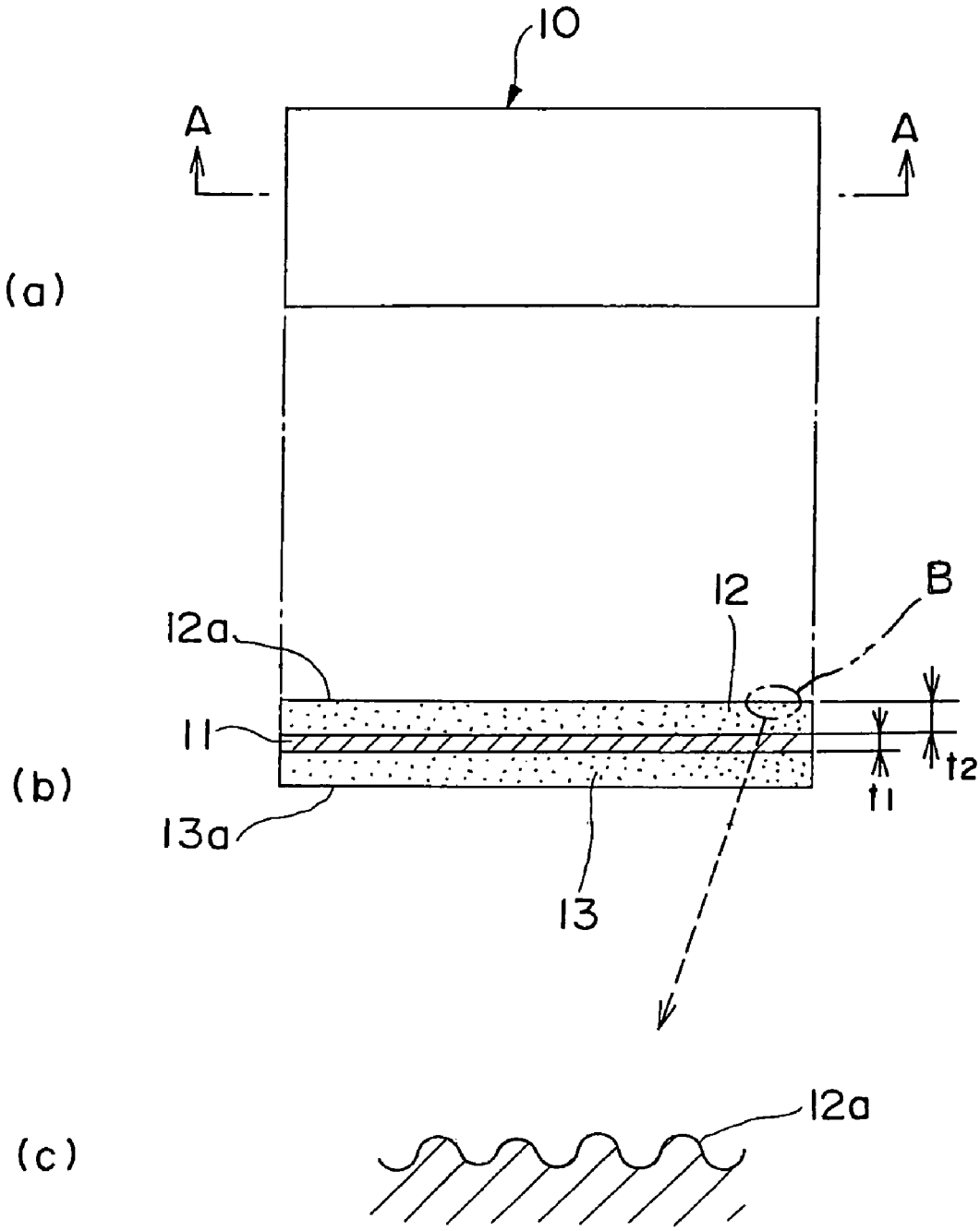
FIG. 2 is a view illustrating a double-stick adhesive tape in accordance with an embodiment of the present invention.
Figure 3:
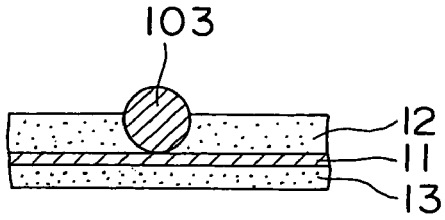
FIG. 3 is a cross-sectional view illustrating the filament about half buried in one side of adhesive surface and adhered peripherally.

An embodiment of the double-stick adhesive tape in accordance with the present invention is explained referring to FIG. 2 and FIG. 3.

FIG. 2(*a*) is a plan view of double-stick adhesive tape 10, (*b*) a cross sectional view, and (*c*) the detailed illustration enlarging the part B of FIG. 2(*b*).

As is clear from FIG. 2(*b*), in the double-stick adhesive tape 10, adhesive layers 12, 13 are formed on its both surfaces, on both sides of transparent core material 11 of, for example, polyethylene film. Since adhesive layers 12, 13 are used to human bodies, low allergic transparent acrylic adhesives applicable to medical field are preferred. At least one side of double-stick adhesive layers 12, 13 is deglossed. In this embodiment, both surfaces of adhesive layers 12, 13 on both sides of the core material 11 are deglossed, but at least the adhesive layer 12 (hereinafter this is called the adhesive layer of one side) bonding to the wig base 101 may be deglossed. Further, though the illustration is omitted, on the adhesive layer of one side 12 and the adhesive layer of the other side 13, release coated paper (not shown) is set cohering respectively as protective layer or protective film. Release coated paper is peeled off the adhesive layers 12, 13 upon using of the double-stick adhesive tape 10. For this purpose, release coated paper is coated with silicone resin.

Here, the core material 11 and the adhesive 12, 13 may be not necessarily transparent, but colored similarly to the head skin, or to the color of net base, for example, such as milk white or skin color, and are preferably provided with camouflage pattern with which the wig base is less recognizable from outside.

Deglossing of the surface of adhesive layers 12, 13 is effected by forming minute concavity and convexity 12*a* on the surface of said adhesive layers 12, 13 as shown in FIG. 2(*c*) (Part B of FIG. 2(*b*)). Said deglossing is preferably, for example, emboss finishing. As such emboss finishing, it may be forming minute concavity and convexity 12*a* directly on adhesive layers by using transcription pattern having the surface of minute concavity and convexity, or emboss finishing on the cohered release coated paper (not shown). The surface roughness (Ra) of the minute concavity and convexity (emboss finish) on adhesive layers are preferably much larger than the light wavelength so that diffuse reflection of visible light (0.38-0.76 μm) can be well caused, for example, 2-10 μm. It is sufficient to form, for example, about 4 μm.

Here are a few examples of forming minute concavity and convexity 12*a*, 13*a* on the surfaces of adhesive layers 12, 13 of the double-stick adhesive tape 10.

First mentioned is the method to form minute concavity and convexity on adhesive layer surface by applying the press having minute saliences on the surface to the adhesive layer surfaces 12, 13 or to release coated paper. Said press may be either plate type or a roller type, and has on its surface minute saliences of surface roughness sufficiently larger than light wavelength as mentioned above, for example, about 4 μm, and minute concavity and convexity 12*a*, 13*a* are formed by applying said press either directly on to the surfaces of adhesive layers 12, 13 of double-stick adhesive tape 10, or on to the release coated paper cohered on to adhesive layers.

The second method is to form minute concavity and convexity by spray coating the adhesive of suitable viscosity to core material 11 for double-stick adhesive tape 10. If the adhesive has suitable viscosity, it can stay on the core material surface as fine granules, so to form minute concavity and convexity.

The third method is to apply blast processing either directly on to the surfaces of adhesive layers 12, 13 of the double-stick adhesive tape 10, or on to release coated paper. In this case, by using not sand but fine particles of dry ice or ice as blast material, since dry ice or ice as blast material melts away after forming concavity and convexity on adhesive layers, blast material does not stay on the surfaces of adhesive layers 12, 13 or release coated paper.

By applying said methods appropriately, minute concavity and convexity can be formed on adhesive layer surfaces 12, 13 when double-stick adhesive tape 10 is manufactured, or after the commercially available double-stick adhesive tape 10 is obtained.

Further, the second characteristics of the double-stick adhesive tape 10 of the present invention is, as shown in FIG. 3, that at least one side of the adhesive layer 12 of adhesive layers 12, 13 is formed to have a thickness to bury more than half of a wire diameter of the filament 103 which makes up the wig base 101.

As the wig base 101, the wire diameter of the generally used filament 103 making up net member is about 100-150 μm as described above and at least the adhesive layer 12 of the double-stick adhesive tape 10 adhering said filament 103 is designed according to the present invention to have the thickness larger than at least half or more of the diameter of the filament 103, that is, thickness of 50-70 μm or more. Thus, by providing one side of adhesive layers 12 with thickness at least half or more of the diameter of filament 103, since about the lower half of filament 103 is wrapped and peripherally adhered in adhesive layer 12 when one side of adhesive layers 12 of the double-stick adhesive tape 10 is pressed to a net base, sufficient adhesive strength can be obtained compared with the prior case of linear adhesion.

Figure 4:
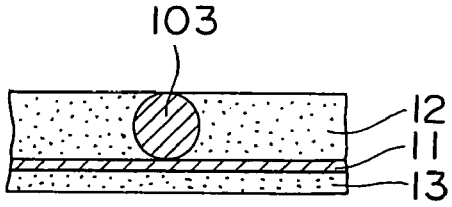
FIG. 4 is a cross-sectional view illustrating the whole periphery of filament buried in one adhesive side of adhesive surface and adhered peripherally.

Further preferably, one side of adhesive layers 12 of double-stick adhesive tape 10 is, as shown in FIG. 4, designed to have thickness equal to, or larger than the wire diameter of filament 103 used for a net base 101. By this design, since the filament 103 is wrapped and adhered in all peripheral direction, extremely strong adhesiveness can be obtained. In essence, the thickness of adhesive layer 12 may be determined with respect to the ratio to wire diameter of filament that makes up the net base.

As shown in FIG. 2(*b*) here, the thickness t1 of core material 11 of double-stick adhesive tape 10 is about 30 μm in usual, and the thickness t2 of adhesive 12 of at least one side of adhesive layers may be about 50-200 μm, more preferably about 150 μm, if the filament diameter is taken into consideration. When the nylon filament of diameter, for example, about 130 μm is used to make up the net member and the one side of adhesive layers 12 of double-stick adhesive tape 10 is formed to be about t2=150 μm thick, and said adhesive layer 12 is pressed and bonded to nylon monofilament, said nylon monofilament 103 penetrates into one side of adhesive layers 12, a part or whole periphery of filament 103 is covered and the filament is peripherally bonded all over the periphery, and adhesive layer 12 is fixed by coming into the network 104 of filament 103. Here, if the thickness t2 of said one side of adhesive layer 12 is too thick, the filament and its network are totally buried therein, become difficult to be peeled off from the wig base 101, as well as adhesive layer 12 may come out upward of the network of the net base, and may adhere to the implanted hair 102. If the thickness is as thin as, for example, 50 μm or less, the peripheral bonding can not be guaranteed.

On the other hand, the other side of adhesive layers 13 of the double-stick adhesive tape 10 to be bonded to a head may not be necessarily designed to have the thickness mentioned above and may be as thick as commercially available double-stick adhesive tape 10 in usual as about 30 μm. Because, since a head is relatively flat in general though somewhat with roughness, the other side of adhesive layer 13 adheres facially. However, in case that the other side of adhesive layers 13 is pressed and bonded on to the hair, it is preferred that the thickness of the other side of adhesive layer 13 is designed as about 50-150 μm so as to effect sufficiently the adhesivity to the head, the diameter of the hair being 50-100 μm in general taken into account.

Here in accordance with this embodiment, as shown in FIG. 1, a plurality of double-stick adhesive tape 10 is adhered to suitable positions, designed along the periphery of the wig base 101 at desired pitch intervals as shown in the figure, and bonded to suitable positions of a head.

Figure 5:
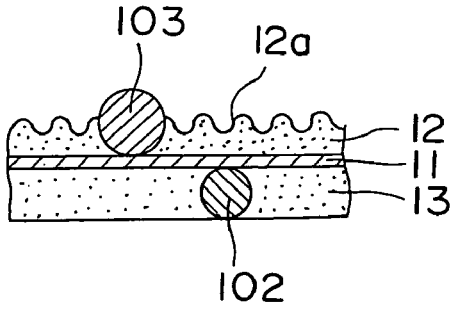
FIG. 5 is a cross-sectional view illustrating the double-stick adhesive tape one adhesive side of which with concavity and convexity surface adheres peripherally to filament, and the other side buries hairs.
Figure 6:
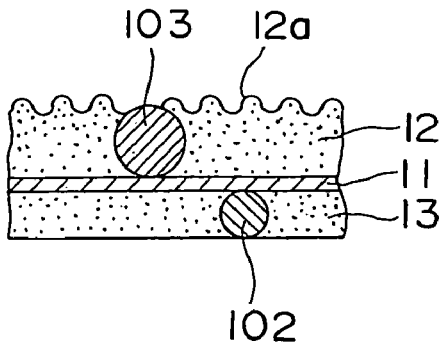
FIG.6 is a cross-sectional view illustrating the double-stick adhesive tape one adhesive side of which with concavity and convexity surface adheres to the whole periphery of filament, and the other side buries hairs.

In accordance with further preferable embodiment of the present invention, as shown in FIG. 5, said adhesive layers 12, 13 of the double-stick adhesive tape 10, especially one side of adhesive layer 12 to be bonded to the wig 100 is designed to have the thickness larger than at least half or more of the diameter of the filament 103, for example, 50-70 μm or more, and the surface of said side of adhesive layer 12 is preferably deglossed as described above. Accordingly, the one side of adhesive layers 12 is firmly bonded to net base, and even if the surface of said adhesive layer 12 can be seen from outside of the wig through the network 104 formed among filaments 103, the adhesive layer is not recognizable by diffuse reflection, and if the adhesive is transparent, the head skin itself can be seen. When the one side of adhesive layers 12 to be bonded to a wig 100 is formed as shown in FIG. 6, as thick as the diameter of filament 103, then whole peripheral bonding around filament 103 can be attained, thereby gripping quality is further improved.

Figure 7:
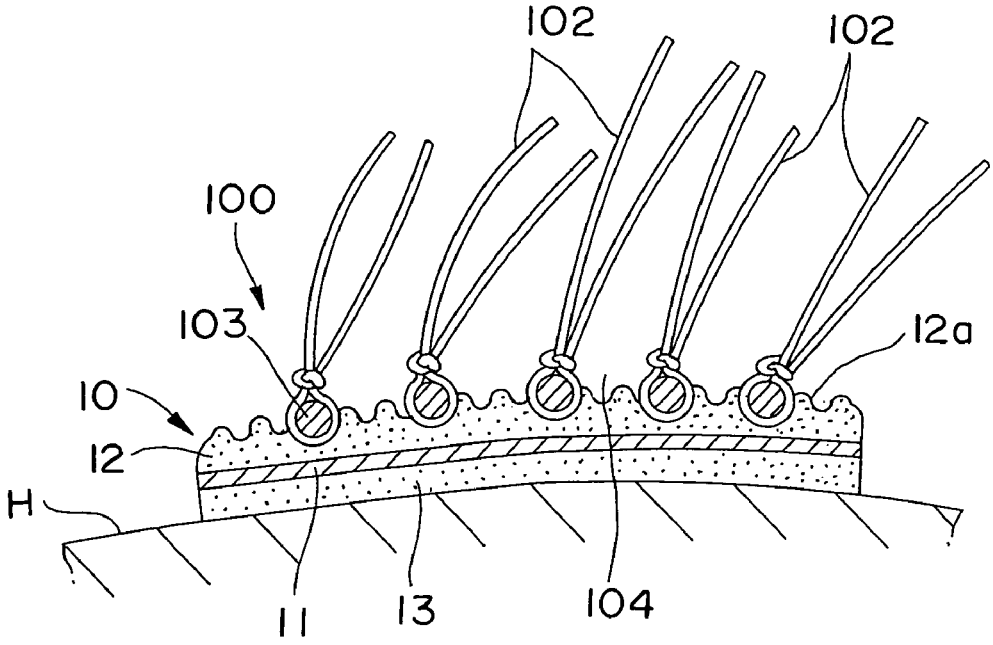
FIG. 7 is a view illustrating the double-stick adhesive tape in use according to the embodiment of the present invention.

FIG. 7 is a cross-sectional view illustrating that one side of adhesive layers 12 having the concavity and convexity surface is formed to be thick and the wig 100 is bonded to a head H using said double-stick adhesive tape 10. The hair 102 is implanted to the wig base 101, while one side of adhesive layers 12 is bonded to filaments 103 which make up the wig base, and the other side of adhesive layers 13 is bonded to a head H. In the wig 100 thus worn on a head H, since the surfaces of adhesive layers 12, 13 are deglossed, the light is prevented to reflect, thereby double-stick tape bonded to the inside of a wig is not recognizable from outside, and good outlook results. Also, since double-stick adhesive tape 10 is transparent, its own color can not be seen from outside, and the outlook can be also improved from this viewpoint. Here, since the adhesive layer 12 penetrating into the network 104 has the surface of minute concavity and convexity, the light from outside reflects diffusely on the rough surface, thereby unnatural gloss caused by the reflecting light is suppressed.

When the double-stick adhesive tape 10 is adhered to the inside of the wig 100, high bondability can be maintained, since adhesive layer 12 comes into network 104 of the wig base 101, and is bonded by peripherally wrapping the periphery of filament 103. That is, since the adhesive layer 12 is designed to have the thickness of about half of the wire diameter of the net member of the wig base 101, or preferably equal to, or more than, that, it comes into network 104 of the net member, and firmly fixes a wig base 101, thereby bonding strength can be effectively enhanced.

Described are the certain examples and the comparative examples of a double-stick adhesive tape and a wig provided with the same.

EXAMPLE 1

The double-stick adhesive tape 10 is made with the transparent core material 11 made of polyethylene film of thickness 30 μm, on both sides of which low allergic and transparent acrylic adhesive is coated to 150 μm thick to form adhesive layers 12, 13. Deglossing effected on the surfaces of adhesive layers 12, 13 is by emboss finishing, and its surface roughness (Ra) to be about 4 μm.

Figure 8:
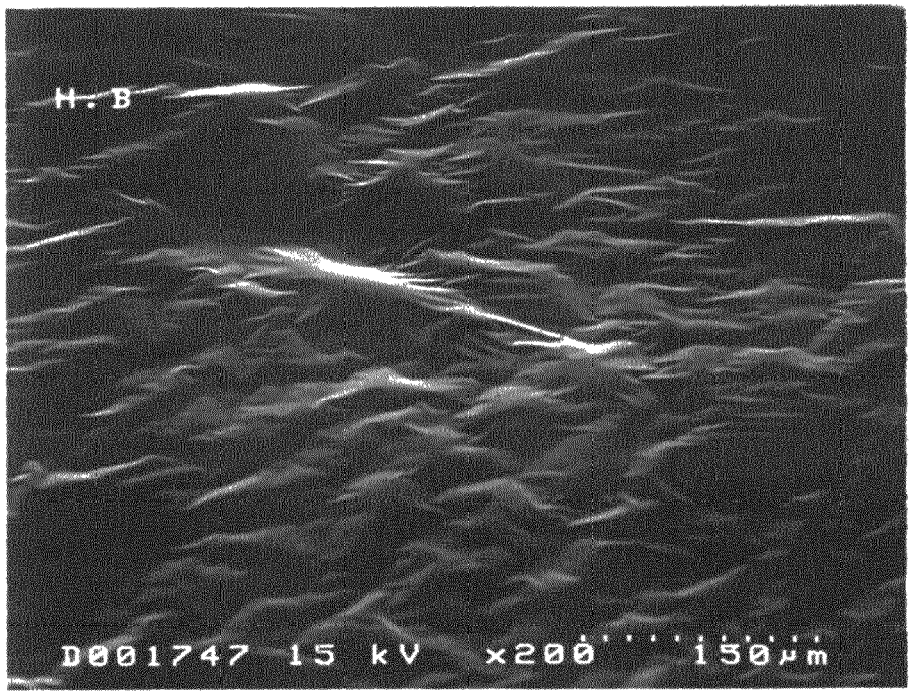
FIG. 8 is a photograph of the adhesive layer surface of one side of the double-stick adhesive tape by the scanning electron microscope (SEM, magnification 200) according to Example 1.

FIG. 8 is a photograph by the scanning electron microscope (SEM) showing the surface with minute concavity and convexity formed on adhesive layers of double-stick adhesive tape 10. The accelerating voltage of electron was 15 keV, and the magnification was 200. As is seen in the figure, minute concavity and convexity are formed on the surface of adhesive layer 12. When light is irradiated on to said adhesive layer 12, no reflection was observed from the surface of adhesive layer 12. On the other side of adhesive layer 13, the surface state and deglossing effect similar to adhesive layer 12 were obtained.

EXAMPLE 2

Said double-stick adhesive tape 10 was bonded to the wig 100. As the wig base 101 of the wig 100, the plain-woven net was used made of filament 103 of nylon6of thread diameter 130 μm. The mesh size of net, that is, the opening indicating the distance between threads was 716.7 μm. The adhesive layer 12 of double-stick adhesive tape 10 is 150 μm thick, and has minute concavity and convexity on its surface by emboss finishing. Here, opening (μm) is expressed as Opening (μm)= 25400/mesh (inch)−thread diameter.

Figure 9:
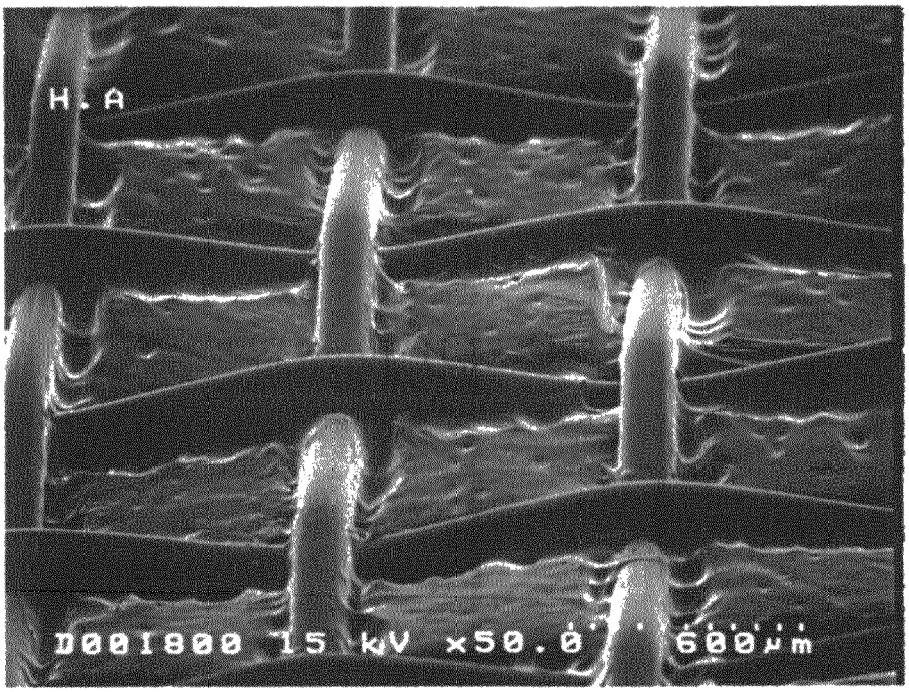
FIG. 9 is a photograph of adhesion of the plain-woven net base and double-stick adhesive tape by the scanning electron microscope (SEM, magnification 50) according to Example 2.

FIG. 9 is a photograph by the scanning electron microscope (SEM) showing the adhesion of a wig base 101 and double-stick adhesive tape 10. The accelerating voltage of electron was 15 keV, and the magnification was 50. In this figure, the surfaces were observed with a wig base 101 at the upper side, and adhesive layer 12 of double-stick adhesive tape 10 at the lower side. The lattice-like filaments 103 of nylon 6 used for a net of the wig base 101 were seen to bite into adhesive layer 12, and to be in peripheral contact.

Said wig 100 was worn by a tester person, and the adhesive strength and outlook observation of double-stick adhesive tape 10 were tested. The adhesive strength of the double-stick adhesive tape 10 to the net of the wig base 101, and to the tester's head skin and hair was both good, and no reflection of light from the surroundings on double-stick adhesive tape 10 was observed. Further, when another tester without a wig 100 observed, it was not recognized that a wig 100 was worn with double-stick adhesive tape 10, thereby the outlook turned out to be excellent.

EXAMPLE 3

Said double-stick adhesive tape 10 was bonded to a wig 100. As the wig base 101 of a wig 100, the net was used made of the cord of filament 103 of nylon 6 of thread diameter 93.3 μm. The mesh size 104 of net (opening) was 1700 μm.

Figure 10:
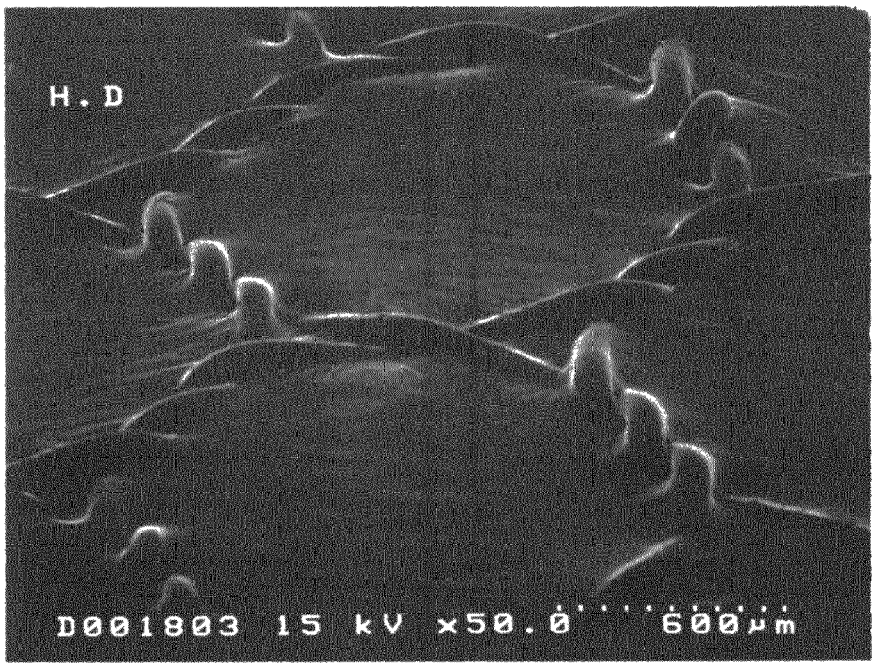
FIG. 10 is a photograph of adhesion of the tulle lace net base and double-stick adhesive tape by the scanning electron microscope (SEM, magnification 50) according to Example 3.

FIG. 10 is a photograph by the scanning electron microscope (SEM) showing the adhesion of a wig base 101 and double-stick adhesive tape 10. The accelerating voltage of electron was 15 keV, and the magnification was 50. In this figure, the surfaces were observed with a wig base 101 at the upper side, and adhesive layer 12 of double-stick adhesive tape 10 at the lower side. The adhesive layer 12 is 150 μm thick as in Example 2, and has minute concavity and convexity formed on its surface. The lattice-like filaments 103 of nylon 6 used as the net of the wig base 101 were seen to bite into adhesive layer 12, and to be in peripheral contact.

Said wig 100 was worn by a tester, and the adhesive strength and outlook observation of double-stick adhesive tape 10 were tested. The adhesive strength of double-stick adhesive tape 10 to the net of the wig base 101, and to the tester's head skin and hair was both good, and no reflection of light from the surroundings on double-stick adhesive tape 10 was observed. Further, when another tester without a wig 100 observed, it was not recognized that a wig 100 was worn with double-stick adhesive tape 10, thereby the outlook turned out to be excellent.

COMPARATIVE EXAMPLE 1

For the double-stick adhesive tape of prior arts, deglossing was not conducted on the adhesive layer surface. Commercially available ordinary adhesive layers were formed with transparent core material 11 made of polyethylene film of thickness 30 μm, on both sides of which low allergic and transparent acrylic adhesive is coated to 50 μm thick, and release coated paper was cohered as protective film.

Figure 11:
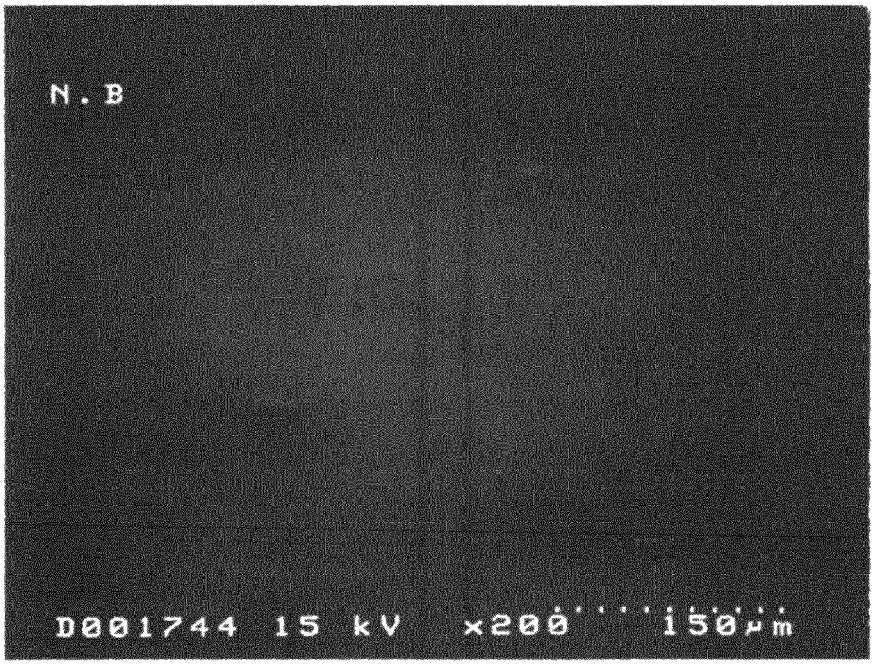
FIG. 11 is a photograph of the adhesive layer surface of one side of conventional double-stick adhesive tape by the scanning electron microscope (SEM, magnification 200) according to Comparative Example 1.

FIG. 11 is a photograph by the scanning electron microscope (SEM) showing the adhesive layer surface of double-stick adhesive tape 10 of prior arts for which no deglossing was conducted. The accelerating voltage of electron was 15 keV, and the magnification was 200. As is shown in the figure, the surface of adhesive layer is seen to be flat and smooth without minute concavity and convexity formed on it. When light is irradiated on to said adhesive layer, reflection was observed from the flat and smooth surface of adhesive layer, unlike the case of the example of the present invention shown in FIG. 8.

COMPARATIVE EXAMPLE 2

Figure 12:
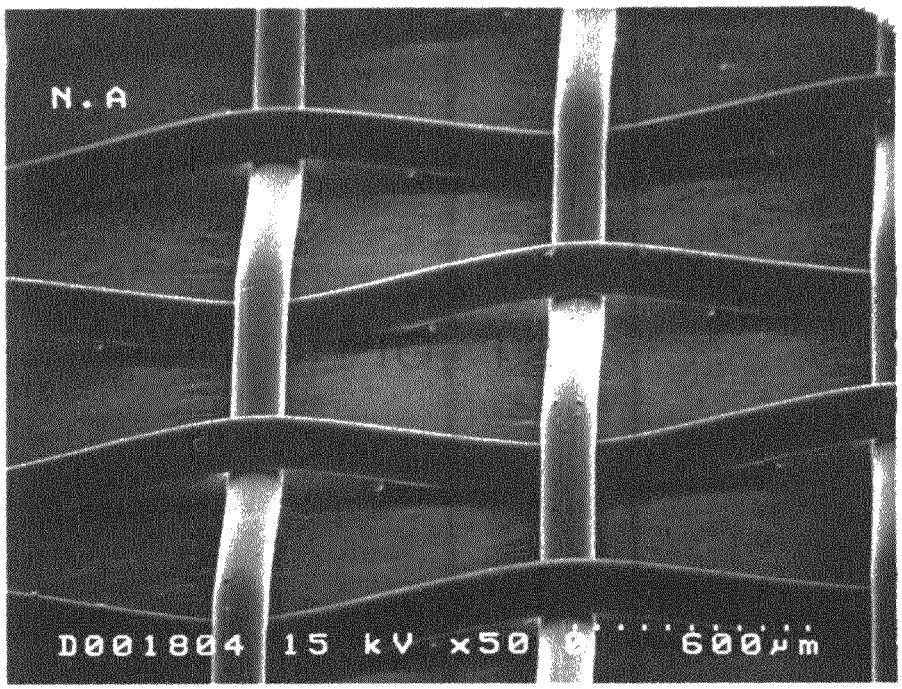
FIG. 12 is a photograph of adhesion of the plain-woven net base and the conventional double-stick adhesive tape by the scanning electron microscope (SEM, magnification 50) according to Comparative Example 2.

The conventional double-stick adhesive tape of Comparative Example 1 was bonded to a wig 100. As the wig base 101, the plain-woven net was used made of filament of nylon 6 of thread diameter 130 μm. The mesh size of net was 30 threads× 30 threads/1 inch (2.54 cm). FIG. 12 is a photograph by the scanning electron microscope (SEM) showing the adhesion of a wig base 101 and double-stick adhesive tape 10. The accelerating voltage of electron was 15 keV, and the magnification was 50. In this figure, the surfaces were observed with a wig base 101 at the upper side, and adhesive layer of conventional double-stick adhesive tape at the lower side.

Unlike the case of Example 2 of the present invention as shown in FIG. 9, the lattice-like filaments of nylon 6 of a wig base 101 were seen to be bonded only partially to the adhesive layer of conventinal double-stick adhesive tape. That is, with the conventional double-stick adhesive tape, the filaments made up of nylon 6 under the mesh of net member is bonded only linearly and partially to adhesive layer. For this reason, conventional double-stick adhesive tape showed poor cohesion to the net of the wig base 101 and the wig wearer's head skin and hair. Since also the adhesive layer of conventional double-stick adhesive tape was flat and smooth surface without concavity and convexity, incoming light caused reflection.

COMPARATIVE EXAMPLE 3

Figure 13:
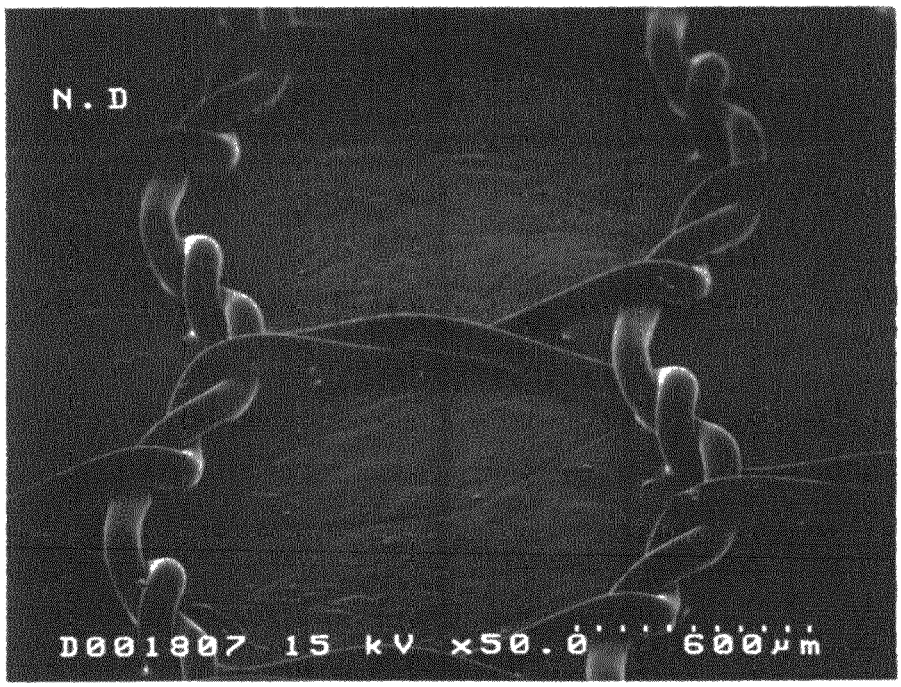
FIG. 13 is a photograph of adhesion of the tulle lace net base and the conventional double-stick adhesive tape by the scanning electron microscope (SEM, magnification 50) according to Comparative Example 3.

The double-stick adhesive tape of Comparative Example 1 was bonded to a wig 100. As the wig base 101 of a wig 100, the tulle lace net was used made of thread of nylon 6 of thread diameter 130 μm. The mesh size of filament was 30 threads× 30 threads/1 inch (2.54 cm). FIG. 13 is a photograph by the scanning electron microscope (SEM) showing the adhesion of a wig base 101 and double-stick adhesive tape 10. The accelerating voltage of electron was 15 keV, and the magnification was 50. In this figure, the surfaces were observed with a wig base 101 at the upper side, and the adhesive layer of conventional double-stick adhesive tape at the lower side.

Unlike the case of Example 3 of the present invention as shown in FIG. 10, the lattice-like filaments of nylon 6 used for the net of the wig base 101 were seen to be bonded only linearly and partially to the adhesive layer of conventional double-stick adhesive tape. That is, with the conventional double-stick adhesive tape, the filaments made up of nylon 6 under the tulle lace of the net of the wig base 101 of a wig 100 is bonded only linearly and partially to adhesive layer. For this reason, conventional double-stick adhesive tape shows poor cohesion to the net of the wig base 101 and the wig wearer's head skin and hair. Since also the adhesive layer of conventional double-stick adhesive tape was flat and smooth surface without concavity and convexity, incoming light caused reflection.

Although certain suitable forms of embodiment of the present invention were explained as above, it should be noted that such forms of embodiment are intended in no way to limit the present invention but might be varied appropriately within the limitation of the present invention. For example, the case was explained where the surfaces of both adhesive layers 12, 13 of double-stick adhesive tape were deglossed, but at least either one side, especially the adhesive layer 12 to be arranged to the wig 100 side, may be deglossed. Also, the minute concavity and convexity for deglossing may be not limited to emboss finishing but of other shapes. Still also, though it is especially preferable to bond the double-stick adhesive tape of the present invention to the net member that is set at least at a part of a wig base, it is of course applicable as ordinary double-stick adhesive tape to a wig base of artificial skin.

Here, the double-stick adhesive tape of the present invention is not limited for wig fixing, but also applicable to various articles, especially effectively applicable to the cases to suppress the gloss of the bonded surface at the side seen from outside. Further, the numerical values indicated in the above-mentioned embodiments may be suitably varied as are necessary.

As is understood from the explanation described above, a double-stick adhesive tape for wig fixing of this type can be obtained with adhesive layers on both sides of a core material, preventing reflection of light by deglossing its surface, its bonding to the inside of a wig is not visible from outside, thereby good looking can be attained. Also, since one side of adhesive layers of the double-stick adhesive tape for bonding is made thick, the adhesive layer penetrates into the network of a wig base when said layer is bonded to the inner side of a wig, thereby high bondability can be attained since it is bonded to filaments not linearly but peripherally.

What is claimed is:

1. A double-stick adhesive tape for a wig having a net member as a portion of a wig base, comprising:

a first adhesive surface layer having a thickness more than half of a diameter of the net member to stick to the net member, and a second adhesive surface layer having a thickness equal to or more than a diameter of human hair, wherein the first adhesive surface layer is thicker than the second adhesive surface layer, and a side of the first adhesive surface layer to the net member has convexities and concavities of the type formed on the surface by pressing, or blast processing, in order to scatter light.

2. The double-stick adhesive tape for the wig as set forth in claim 1, wherein the thickness of the first adhesive surface layer is between 50 and 200 μm and the thickness of the second adhesive surface layer is between 50 and 150 μm.

3. The double-stick adhesive tape for the wig as set forth in 1, wherein the concavities and convexities are provided by pressing the first adhesive surface layer with a press.

4. The double-stick adhesive tape for the wig as set forth in claim 1, wherein the concavities and convexities are formed by blast processing.

* * * * *